US006048219A

United States Patent [19]

Kotowski

[11] Patent Number: 6,048,219

[45] Date of Patent: Apr. 11, 2000

[54] VOLTAGE SELECTION ELECTRICAL CONNECTOR

[75] Inventor: Dave G. Kotowski, Round Lake Beach, Ill.

[73] Assignee: Illinois Tool Works Inc., Glenview, Ill.

[21] Appl. No.: 09/103,018

[22] Filed: Jun. 23, 1998

[51] Int. Cl.[7] ..... H01R 27/00

[52] U.S. Cl. ..... 439/221; 439/956; 439/488; 310/71; 318/442

[58] Field of Search ..... 439/221, 956, 439/955, 488; 318/111, 112, 113, 442; 310/71

[56] References Cited

U.S. PATENT DOCUMENTS

| | | | |
|---|---|---|---|
| 2,727,215 | 12/1955 | Brown | 439/221 |
| 3,139,492 | 6/1964 | Cage | 439/221 |
| 3,231,767 | 1/1966 | Powell | 310/71 |
| 3,453,403 | 7/1969 | Hoffman | 200/51 R |
| 3,602,748 | 8/1971 | Locke | 310/71 |
| 3,983,407 | 9/1976 | Shott | 307/146 |
| 4,394,549 | 7/1983 | Dennis | 200/16 E |
| 4,429,935 | 2/1984 | Lamb et al. | 439/516 |
| 4,547,689 | 10/1985 | Tsuchimoto et al. | 310/71 |
| 4,609,244 | 9/1986 | Buscher et al. | 439/217 |
| 4,748,355 | 5/1988 | Anderson et al. | 310/71 |
| 4,781,610 | 11/1988 | Mercer | 439/217 |
| 4,937,482 | 6/1990 | Dohogne | 310/71 |
| 5,017,818 | 5/1991 | Dohogne | 310/71 |
| 5,543,671 | 8/1996 | Williams | 310/71 |

*Primary Examiner*—Khiem Nguyen
*Assistant Examiner*—T C Patel
*Attorney, Agent, or Firm*—John P. O'Brien

[57] ABSTRACT

An electrical connector for configuring the supply voltage of rotary electric machines, particularly electric motors, having a plurality of electrical windings. The connector includes an electrical terminal block mountable in a bell housing of the rotary electric machine. The terminal block includes a socket having a plurality of female electrical connectors coupled to a corresponding plurality electrical windings. A male electrical connector having a plurality of jumper pins matably engageable with the female electrical connectors of the socket in a first and second configurations to electrically configure first and second winding portions of each electrical winding in parallel or in series. The connector also includes a visual electrical configuration indicator to indicate whether the male electrical connector and socket are in the first or second configurations.

10 Claims, 4 Drawing Sheets

VOLTAGE SELECTION ELECTRICAL CONNECTOR

BACKGROUND OF THE INVENTION

The invention relates generally to electrical connectors, and more particularly to plug and socket electrical connectors useable for configuring the operating voltage of rotary electric machines.

It is known generally to re-configure electrical windings of rotary electric machines, including electric motors and generators, for operation at different voltages. It is known also to re-configure electrical windings to change the direction of current, thereby reversing the rotational direction of the machine. In the heating industry, for example, some furnace motors operate on power lines supplying either 110 or 220 volt electrical service. To accommodate these different supply line voltages, first and second winding portions of each electrical winding are configured in series for operation at the higher voltage, or in parallel for operation at the lower voltage.

One known approach to re-configuring furnace motor windings is to remove a bell housing portion from the motor, and to rewire an electrical terminal board mounted in the bell housing for either high or low voltage power supply operation. This approach however is costly and labor intensive, and requires generally the skill of an electrical technician since disassembly of the motor and electrical rewiring is required.

Another approach to re-configuring rotary electric machine windings generally is to couple the electrical windings to corresponding female connectors of a socket and to provide a male plug connector having a plurality of jumper pins matable therewith. U.S. Pat. No. 3,453,403 to Hoffman, for example, discloses multiple male plugs and a common female socket portion, wherein one of the male plugs is shiftably orientable relative to and matable with the female socket portion to electrically configure the windings for different modes of operation. In Hoffman, however, the multiple male plugs may be confusing, and it is not possible to determine the electrical configuration of the motor until a cover plate is re-installed over the male connectors.

U.S. Pat. No. 4,394,549 to Dennis discloses electric motor windings coupled to corresponding female connectors of a socket and a male plug connector shiftably orientable relative thereto and matable therewith to electrically configure the windings for different modes of operation. The socket portion of this system however is separate from the motor housing, and requires a sophisticated switching mechanism for coupling and shifting the male plug connector relative to the female socket.

U.S. Pat. No. 4,937,482 to Dohogne also discloses a matable male and female connector combination for electrically configuring motor windings for different modes of operation. The male plug connector is shiftably orientable relative to the female portion to change the rotational direction of the motor, and the male plug connector is rotatably orientable relative to the female portion to change the motor operating voltage configuration.

The present invention is drawn toward advancements in the art of electrical connectors, and more particularly to plug and socket electrical connectors useable for configuring electrical windings of rotary electric machines, including electric motors, for operating at different voltages, and combinations thereof.

It is an object of the invention to provide novel electrical connectors for configuring electrical windings of rotary electric machines, including electric motors, and combinations thereof, that overcome problems in the art.

It is also an object of the invention to provide novel electrical connectors, for configuring electrical windings of rotary electric machines, that are economical, that are relatively easy to install and manipulate, and that visually indicate the configuration of the windings.

It is a more particular object of the invention to provide novel electrical connectors for configuring the supply voltage of rotary electric machines, particularly electric motors, having a plurality of electrical windings. The connectors comprise generally an electrical terminal block mountable in a bell housing of the rotary electric machine. The terminal block includes a socket having a plurality of female electrical connectors coupled to a corresponding plurality electrical windings. A male electrical connector includes a plurality of pins, some of which are electrically connected by jumpers, that are matably engageable with the female electrical connectors of the socket in a first or second configuration to electrically configure first and second winding portions of each electrical winding in parallel or in series. The electrical connector also includes a visual electrical configuration indicator to indicate whether the male electrical connector and socket are in the first or second configurations.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
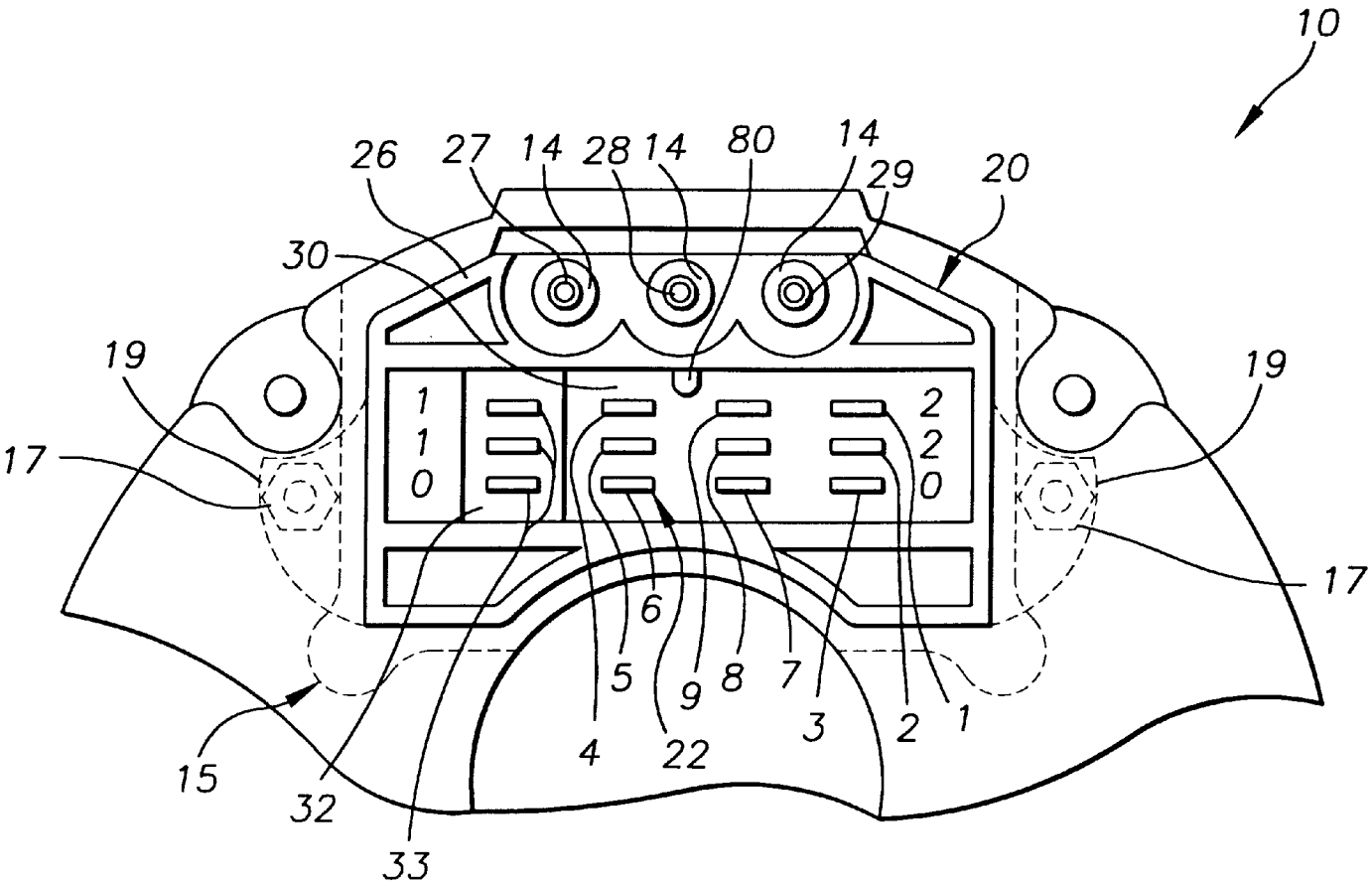
FIG. 1 is a partial end view of an electrical terminal block mounted in a bell housing of a rotary electric machine, for example an electric motor.

FIG. 1 is a partial end view of a bell housing 10 of a rotary electric machine having a terminal block 20 mounted therein, for example by bolts 17 disposed through flanges 19 on opposing sides thereof and fastened to the interior of the bell housing, or by other known means. A cover plate 15, shown in phantom, is mountable to the bell housing 10 and over the terminal block 20 as is known generally. In the exemplary embodiment, the rotary electric machine is an electric motor configurable to operate on 110 or 220 volt power supply lines, but more generally the machine may be any electric motor or generator configurable for operating at different voltages.

Figure 2:
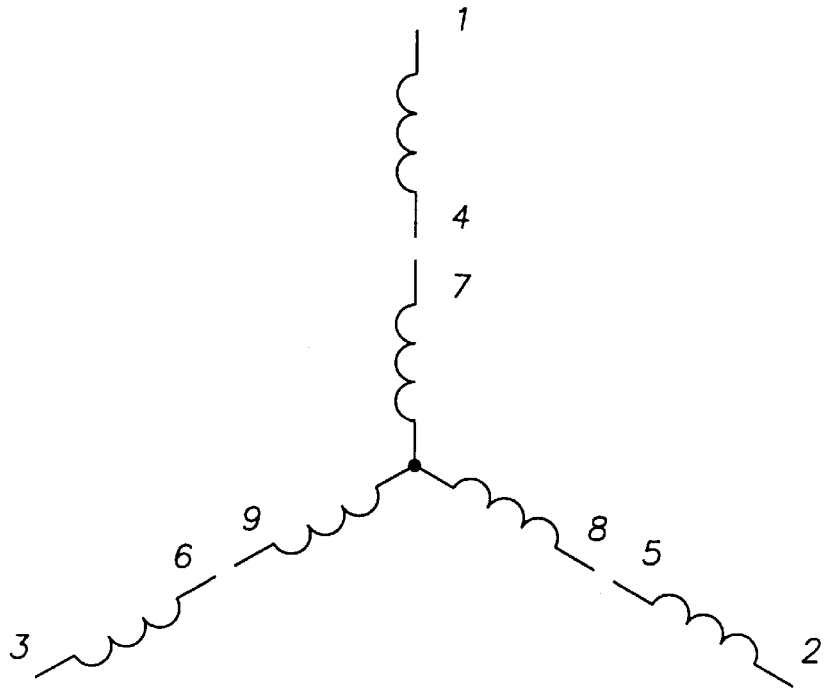
FIG. 2 is a partial electrical schematic of an exemplary electrical winding configuration, wherein each winding includes first and second winding portions.
Figure 3:
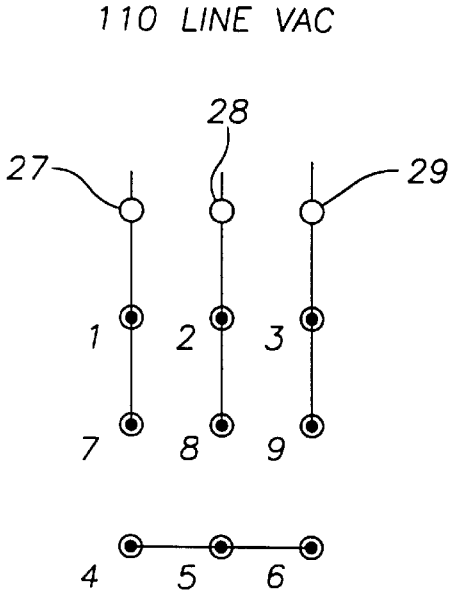
FIG. 3 is a partial electrical schematic of the first and second winding portions of each winding of FIG. 2 connected in parallel.
Figure 4:
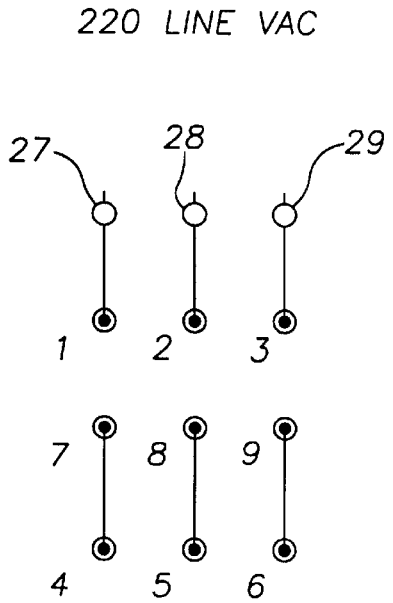
FIG. 4 is a partial electrical schematic of the first and second winding portions of each winding of FIG. 2 connected in series.

Rotary electric machines comprise generally a plurality of electrical windings. FIG. 2 is a partial electrical schematic of electrical windings for the exemplary electric motor, and more generally for any rotary electric machine, having three electrical windings arranged in a star configuration. The electrical windings may be arranged alternatively in a delta configuration as is known generally. In the exemplary embodiment, the three electrical windings each have a first inner winding portion with corresponding outer ends 7, 8 and 9. Also, the three electrical windings each have a second outer winding portion with corresponding inner ends 4, 5 and 6, and corresponding outer ends 1, 2 and 3. FIG. 3 is a partial electrical schematic of the first and second winding portions of FIG. 2 connected in parallel for operation at the lower voltage, and FIG. 4 is a partial electrical schematic of the first and second winding portions of FIG. 2 connected in series for operation at the higher voltage.

Figure 7:
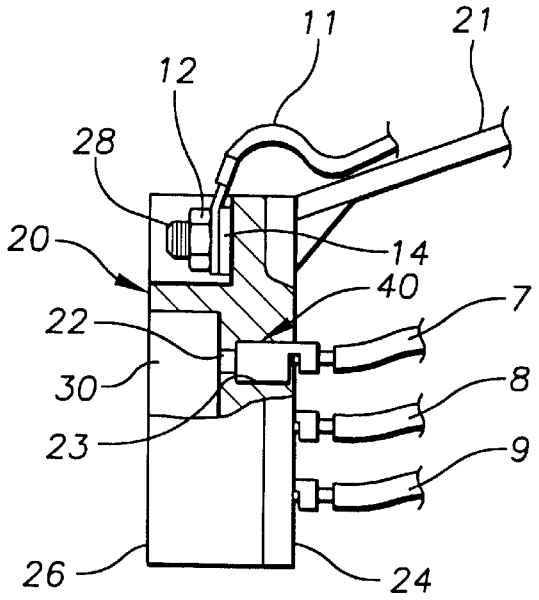
FIG. 7 is a partial sectional view of an electrical terminal block.

FIGS. 1 and 7 illustrate a socket 30 having a plurality of openings 22 therethrough, only one of which is identified to simplify the drawing, at least some of which have a corresponding female electrical connector 40 mounted therein. The female electrical connectors 40 are of a known type, and are snap-fit or otherwise securely fastened to the terminal block 20, for example in a corresponding enlarged recess portion 23 on an inner side 24 of the terminal block 20, by means known generally. More particularly, the electrical winding ends 1–9 are each coupled electrically to a corresponding female electrical connector 40 disposed in a corresponding opening 22 of the terminal block 20, where the electrical winding ends 1–9 and corresponding female electrical connectors 40 are accessible from the outer side 26 of the terminal block 20 to electrically configure the rotary electric machine as discussed further below. In FIG. 1, the plurality of openings 22 are numbered 1–9 corresponding to the electrical winding ends 1–9 and corresponding female electrical connectors mounted therein, not visible in FIG. 1, but accessible through openings 22.

FIG. 1 illustrates the terminal block 20 having a plurality of electrical service power supply line connectors, which in the exemplary embodiment are threaded studs 27, 28 and 29 protruding from the outer side 26 thereof. Electrical service wires are connectable to the power supply line connectors, or studs, for supplying power to or from the rotary electric machine, and more particularly to or from the plurality of electrical windings thereof, depending on whether the rotary electric machine is an electric motor or generator. FIG. 7 illustrates an electrical service wire 11 electrically coupled to the stud 28 by a nut 12 disposed thereabout to clampingly engage the wire 11 against a radial flange 14 of the stud 28. The power supply line connectors may alternatively and equivalently be threaded nuts into which corresponding bolts or other fasteners are coupled to electrically connect the electrical service wires thereto.

The terminal block 20 includes electrical jumpers, or wires, extending from each of the studs 27, 28 and 29 and coupled to a corresponding one of the electrical winding ends 1, 2 and 3. An equivalent electrical schematic thereof is illustrated in FIGS. 2 and 3, wherein the electrical service wires, which are either 110 or 220 line VAC in the exemplary embodiment, are coupled to corresponding windings ends 1, 2 and 3. The studs 27, 28 and 29 of the terminal block 20, for example, may be coupled electrically to the female electrical connectors 40 corresponding to and connected to the winding ends 1, 2 and 3.

In FIG. 7, the terminal block 20 has a tongue portion 21 extending from an upper portion of the inner side 24 thereof. The tongue portion 21 separates the electrical service wires 11 from the windings of the rotary electric machine and channels the electrical service wires 11, typically supplied though an opening in the rotary electric machine housing, to the power supply line connectors, or studs, 27, 28 and 29 of the terminal block, where the wires are fastened, as discussed above.

The terminal block 20 including the socket portion 30, the flanges 19 and tongue portion 21 thereof may be formed unitarily of a heat stabilized nylon or other suitable insulating material in a molding operation. The conducting power supply line connectors, or studs, 27, 28 and 29 and flange portions 14 thereof may be insert molded in the terminal block 20, or fastened thereto by other known means. In some embodiments, it may be advantageous to insert mold in the terminal block 20 the female connectors 40 and the corresponding electrical jumpers from the studs.

Figure 8:
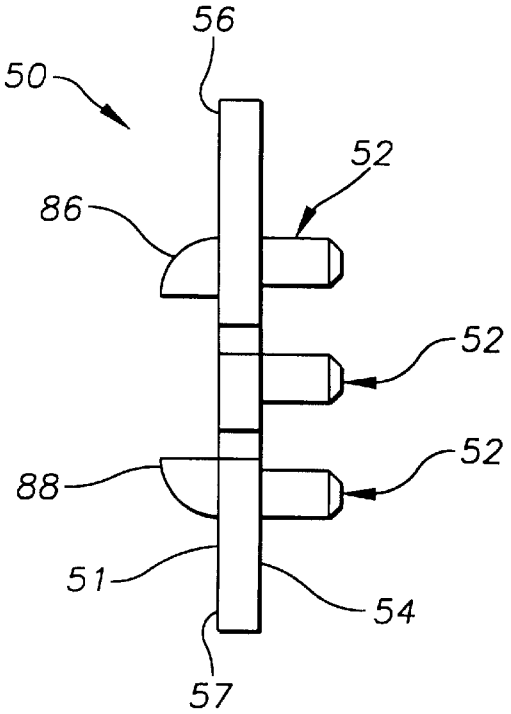
FIG. 8 is a side view of a male electrical connector.
Figure 9:
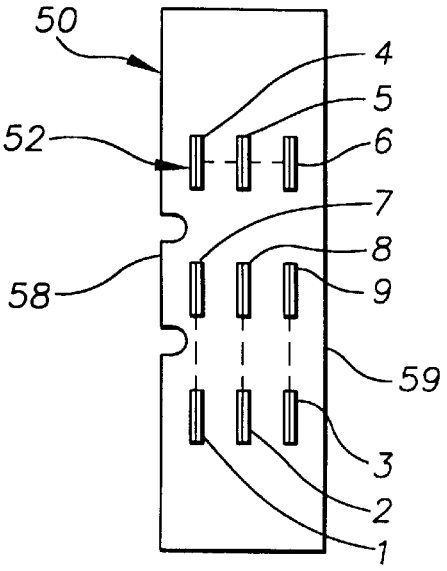
FIG. 9 is an inner side view of the male connector of FIG. 8.

FIG. 8 illustrates a male electrical connector 50 having a plurality of pins 52 protruding from an inner side 54 thereof. The pins 52 are frictionally engageable with a corresponding one of the female electrical connectors 40 upon inserting the pins 52 into corresponding openings 22 of the socket 30, as discussed further below. FIG. 9 illustrates some of the plurality of pins 52 electrically connected by electrical jumpers, or wires, shown in phantom. In the exemplary embodiment, a first pin 1 of the first row of the male electrical connector 50 is coupled electrically to a first pin 7 of the second row of the male electrical connector 50. A second pin 2 of the first row of the male electrical connector 50 is coupled electrically to a second pin 8 of the second row of the male electrical connector 50. A third pin 3 of the first row of the male electrical connector is coupled electrically to a third pin 9 of the second row of the male electrical connector. And first, second and third pins 4, 5 and 6 of the third row of the male electrical connector are coupled electrically together.

The plurality of pins 52 of the male electrical connector 50 are matably engageable generally with corresponding female electrical connectors 40 in one of first and second matable configurations. FIG. 3 illustrates an electrical schematic of the first matable configuration therebetween, which electrically connects the first and second windings of each electrical winding in parallel for operation at the lower voltage, and FIG. 4 illustrates an electrical schematic of the second matable configuration therebetween, which electrical connects the first and second windings of each electrical winding in series for operation at the higher voltage.

Figure 5:
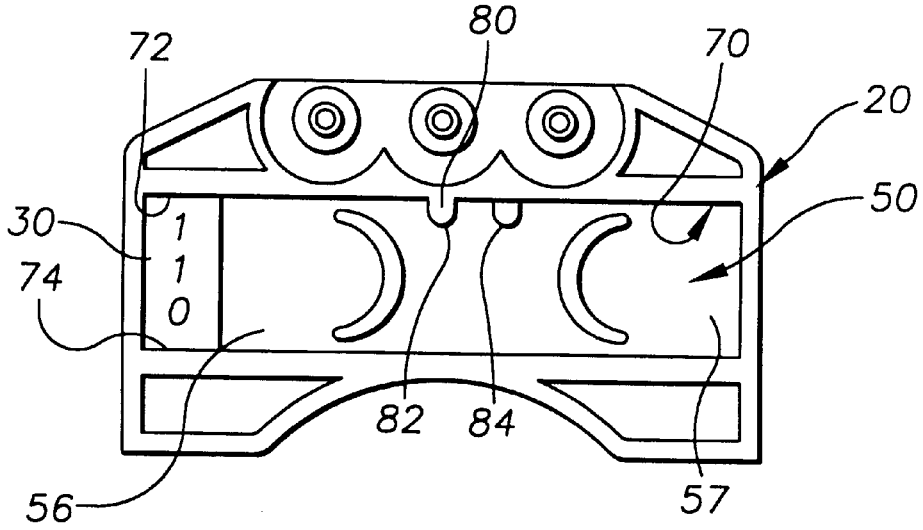
FIG. 5 is a partial view of the terminal block having a male electrical connector in a first position for configuring the machine to operate at a first voltage.
Figure 6:
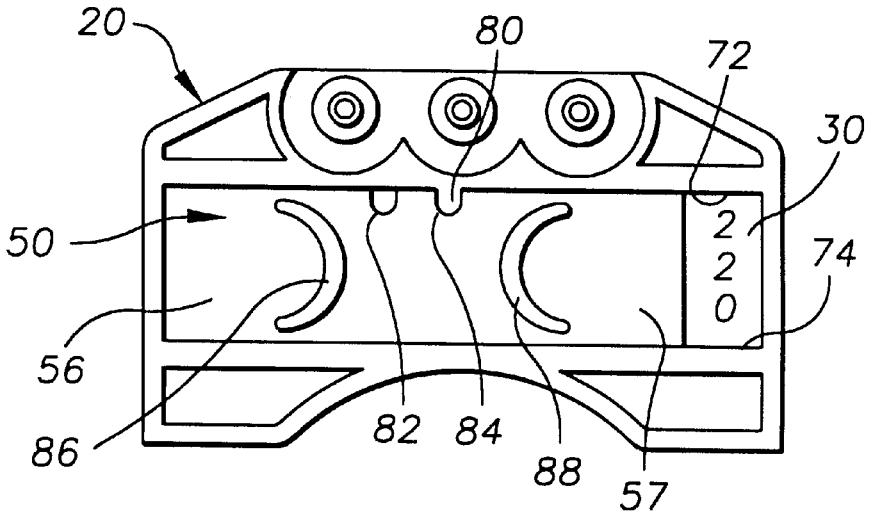
FIG. 6 is a partial view of the terminal block having the male electrical connector in a second position for configuring the machine to operate at a second voltage.

FIG. 1 illustrates the plurality of openings 22 and corresponding female electrical connectors of the socket 30 arranged in a first array, and FIG. 9 illustrates the plurality of pins 52 of the male electrical connector 50 arranged in a second, complementary array. The plurality of pins 52 of the male electrical connector 50 are matably engageable with different female electrical connectors 40 of the socket 30, and thus different winding ends, by shifting the male electrical connector between one of first and second positions relative thereto. FIG. 5 illustrates the male electrical connector 50 in the first position corresponding to the first matable configuration electrically connecting the first and second windings of each electrical winding in parallel for operation at the lower voltage. FIG. 6 illustrates the male electrical connector 50 in the second position corresponding to the second matable configuration electrically connecting the first and second windings of each electrical winding in series for operation at the higher voltage. An equivalent of the exemplary embodiment is for the conducting pins 52 to protrude from the terminal block 20 mounted on the bell housing, and for the female electrical connectors 40 to be located in the connector 50.

In the exemplary embodiment of FIG. 1, the plurality of openings 22 and corresponding female electrical connectors 40 of the socket 30 are arranged in a first array having three rows and three columns. And in the exemplary embodiment of FIG. 9, the plurality of pins 52 of the male electrical connector 50 are arranged in a second, complementary array also having three rows and three columns. When the male electrical connector 50 is in the first position illustrated in FIG. 5, the first, second and third rows of pins 52 thereof are matably engaged with corresponding first, second and third rows of female electrical connectors 40 of the socket 30 to electrically configure the windings in parallel as illustrated in FIG. 3. More particularly, pins 1–9 of the male electrical connector 50 are coupled to the female electrical connectors corresponding to winding ends 1–9, respectively, which are identified also in FIG. 1.

When the male electrical connector 50 is in the second position illustrated in FIG. 6, the first and second rows of pins 52 thereof are matably engaged with corresponding second and third rows of female electrical connectors 40 of the socket 30 to electrically configure the windings in series as illustrated in FIG. 4. More particularly, pins 1–3 of the male electrical connector 50 are coupled to the female electrical connectors corresponding to winding ends 7–9, respectively, and pins 7–9 of the male electrical connector 50 are coupled to the female electrical connectors corresponding to winding ends 4–6.

When the male electrical connector 50 is in the second position illustrated in FIG. 6, the pins 4–6 of the male electrical connector 50 are not coupled to any electrical windings. FIG. 1 illustrates the socket 30 including generally a recessed portion 32 for accommodating pins 4, 5 and 6 in the third row of the male electrical connector 50 not matably engaged with any electrical windings. In the exemplary embodiment, the recess is a plurality of corresponding openings 33 formed in the socket 30 of the terminal block 20. The openings 33 however do not provide any electrical connection with the electrical windings.

FIGS. 1, 5 and 6 illustrate a visual electrical configuration indicator for indicating visually whether the male electrical connector 50 is in the first position or the second position, and thus whether the male electrical connector 50 and female electrical connectors 40 are in the first or second matable configuration to connect the windings in parallel or in series. In the exemplary embodiment, the indicator comprises first and second visual indicators "110" and "220" disposed on the socket 30 and located on corresponding opposing sides of the array of openings 22 therein and the corresponding female electrical connectors, generally.

Also in the exemplary embodiment, the male electrical connector 50 comprises first and second wing portions 56 and 57 disposed on opposing end portions thereof. FIG. 5 illustrates the second wing portion 57 overlapping the second visual indicator "220" when the male electrical connector is in the first position, whereby the windings are configured in parallel. FIG. 6 illustrates the first wing portion 56 overlapping the first visual indicator "110" when the male electrical connector 50 is in the second position, whereby the windings are configured in series. The configuration of the windings is thus indicated clearly and unmistakably, thereby substantially eliminating the possibility that an improper voltage will be applied thereto.

FIGS. 1, 5 and 6 illustrate a male connector receptacle 70 disposed on the terminal block 20 and about the plurality openings 22 on the socket 30, thus forming a housing therefor. The male connector receptacle 70 comprises generally opposing side wall portions 72 and 74 that align the male electrical connector 50 relative to the socket 30. In the exemplary embodiment, the male electrical connector has a generally rectangular body member with generally opposing side wall portions 58 and 59 that are aligned and constrained by the generally opposing side wall portions 72 and 74 of the male connector receptacle 70. The male connector receptacle 70 thus aligns the conducting pins 52 of the male electrical connector 50 in one dimension relative to the openings 22 and the corresponding female electrical connectors 40.

FIGS. 1, 5 and 6 illustrate a socket indexing member 80 on the socket 30, and first and second complementary indexing members 82 and 84 on the male electrical connector 50. FIG. 5 illustrates the socket indexing member 80 engaged with the first indexing member 82 when the male electrical connector 50 is in the first position, and FIG. 6 illustrates the socket indexing member 80 engaged with the second indexing member 84 when the male electrical connector 50 is in the second position. The indexing members 80, 82 and 84 are located so that the pins 52 of the male electrical connector 50 are aligned accurately with the appropriate female electrical connectors 40 in the first and second positions, thereby facilitating insertion of the male electrical connector 50 into the socket 30 to readily configure the electrical windings in series or parallel, as discussed above.

FIGS. 1, 5 and 6 also illustrate a gripping member protruding from the outer side portion 51 of the male electrical connector 50 to facilitate gripping thereof. In the exemplary embodiment, the gripping member includes first and second contoured gripping portions 86 and 88, which are formed preferably unitarily with the male electrical connector 50. The body portion and gripping members of the male electrical connector 50 may be formed, for example, of an insulating material like a heat stabilized nylon material or other suitable material in a molding operation. In the exemplary embodiment, the conducting pins 52 are blade shaped members, which are known generally and formable inexpensively in stamping operations or otherwise, and may be insert molded or otherwise fastened to the body member of the male electrical connector 50. The electrical jumpers, or wires, that electrically connect the pins 52, as discussed above, may also be insert molded in the body member of the male electrical connector 50.

While the foregoing written description of the invention enables one of ordinary skill to make and use what is considered presently to be the best mode thereof, those of ordinary skill will appreciate and acknowledge the existence of variations, combinations, and equivalents of the specific exemplary embodiments herein. The invention is therefore to be limited not by the exemplary embodiments, but by all embodiments within the scope and spirit of the appended claims.

What is claimed is:

1. An electrical connector useable for changing an operating voltage configuration of a rotary electric machine having a plurality of electrical windings with first and second winding portions, comprising:

an electrical terminal block mountable in a bell housing of the rotary electric machine;

a socket having a plurality of female electrical connectors, each of the plurality of first and second winding portions coupled to a corresponding one of the female electrical connectors;

a male electrical connector having a plurality of pins, some of the plurality of pins electrically connected by electrical jumpers;

the plurality of pins of the male electrical connector matably engageable with the female electrical connectors of the socket in one of first and second matable configurations, the first matable configuration electrically connecting the first and second winding portions of each electrical winding in parallel, and the second matable configuration electrically connecting the first and second winding portions of each electrical winding in series; and a visual electrical configuration indicator having first and second indicator portions on the socket, only one of the first and second indicator portions visible to indicate whether the male electrical connector and socket are in the first or second matable configuration.

2. The electrical connector of claim 1 further comprising the plurality of female electrical connectors of the socket arranged in a first array, and the plurality of pins of the male electrical connector arranged in a second complementary array, the plurality of pins of the male electrical connector matably engageable with different female electrical connectors of the socket by shifting the male electrical connector between one of first and second positions relative to the socket.

3. The electrical connector of claim 2 further comprising a male connector receptacle on the terminal block housing a plurality of openings corresponding to the plurality of female electrical connectors, the male connector receptacle having generally opposing side wall portions for aligning and constraining the male electrical connector relative to the socket.

4. The electrical connector of claim 3 further comprising a socket indexing member on the socket, and first and second complementary indexing members on the male electrical connector, the socket indexing member engaged with the first indexing member when the male electrical connector is in the first position, and the socket indexing member engaged with the second indexing member when the male electrical connector is in the second position.

5. The electrical connector of claim 3 further comprising the male electrical connector having a generally rectangular body member with the plurality of conducting pins protruding from an inner side portion thereof, generally opposing side wall portions of the male electrical connector aligned and constrained by the generally opposing side wall portions of the male connector receptacle.

6. The electrical connector of claim 5 further comprising a recessed portion on the socket for accommodating pins of the male electrical connector not matably engaged with female electrical connectors.

7. The electrical connector of claim 1 further comprising the terminal block having a plurality of power supply line connectors coupled electrically to a corresponding one of the plurality of electrical windings and connectable to electric service wires.

8. The electrical connector of claim 1, the rotary electric machine is an electric motor having three electrical windings in a star configuration, each electrical winding having a first inner winding portion with an outer end and a second outer winding portion with an inner end and an outer end, the connector further comprising:

the ends of the three electrical windings coupled to a corresponding one of the female electrical connectors, the female electrical connectors arranged in an array having three rows and three columns;

the plurality of pins of the male electrical connector arranged in a second complementary array having three rows and three columns; and the first, second and third rows of pins of the male electrical connector matably engaged with corresponding first, second and third rows of female electrical connectors of the socket when the male electrical connectors is in the first position, and the first and second rows of pins of the male electrical connector matably engaged with the second and third rows of female electrical connectors of the socket when the male electrical connector is in the second position.

9. The electrical connector of claim 8 further comprising:

a first pin of the first row of the male electrical connector coupled electrically to a first pin of the second row of the male electrical connector;

a second pin of the first row of the male electrical connector coupled electrically to a second pin of the second row of the male electrical connector;

a third pin of the first row of the male electrical connector coupled electrically to a third pin of the second row of the male electrical connector; and first, second and third pins of the third row of the male electrical connector coupled electrically.

10. An electrical connector useable for changing an operating voltage configuration of a rotary electric machine having a plurality of electrical windings with first and second winding portions, comprising:

an electrical terminal block mountable in a bell housing of the rotary electric machine;

a socket having a plurality of female electrical connectors arranged in a first array, each of the plurality of first and second winding portions coupled to a corresponding one of the female electrical connectors;

a male electrical connector having a plurality of pins arranged in a second complementary array, some of the plurality of pins electrically connected by electrical jumpers;

a male connector receptacle on the terminal block housing a plurality of openings corresponding to the plurality of female electrical connectors, the male connector receptacle having generally opposing side wall portions for aligning and constraining the male electrical connector relative to the socket, the male electrical connector having a generally rectangular body member with the plurality of conducting pins protruding from an inner side portion thereof, generally opposing side wall portions of the male electrical connector aligned and constrained by the generally opposing side wall portions of the male connector receptacle.

the pulrality of pins of the male electrical connector matably engageable with the female electrical connectors of the socket in one of first and second matable configurations by shifting the male electrical connector between one of first and second positions relative to the socket, the first matable configuration electrically connecting the first and second winding portions of each electrical winding in parallel, and the second matable configuration electrically connecting the first and second winding portions of each electrical winding in series;

first and second visual indicators disposed on the socket on opposing sides of the openings providing access to the corresponding female electrical connectors, the visual electrical configuration indicator indicating visually whether the male electrical connector and socket are in the first or second matable configuration, the male electrical connector having first and second wing portions disposed on opposing end portions thereof, the first wing portion overlapping the first visual indicator when the male electrical connector is in the second position, and the second wing portion overlapping the second visual indicator when the male electrical connector is in the first position.

* * * * *